US011083257B2

(12) United States Patent
Gao

(10) Patent No.: US 11,083,257 B2
(45) Date of Patent: Aug. 10, 2021

(54) DEFORMABLE CRUTCH

(71) Applicant: Xiaohui Gao, Shijingshan Beijing (CN)

(72) Inventor: Xiaohui Gao, Shijingshan Beijing (CN)

( * ) Notice: Subject to any disclaimer, the term of this patent is extended or adjusted under 35 U.S.C. 154(b) by 0 days.

(21) Appl. No.: 16/626,915

(22) PCT Filed: Feb. 1, 2018

(86) PCT No.: PCT/CN2018/074944
§ 371 (c)(1),
(2) Date: Dec. 27, 2019

(87) PCT Pub. No.: WO2019/010963
PCT Pub. Date: Jan. 17, 2019

(65) Prior Publication Data

US 2020/0138153 A1 May 7, 2020

(30) Foreign Application Priority Data

Jul. 11, 2017 (CN) ..... 201720840005.4

(51) Int. Cl.
*A45B 5/00* (2006.01)
*A61H 3/02* (2006.01)
(Continued)

(52) U.S. Cl.
CPC ..... *A45B 5/00* (2013.01); *A61H 3/02* (2013.01); *A45B 9/02* (2013.01); *A45B 2200/05* (2013.01);
(Continued)

(58) Field of Classification Search
CPC ..... A61H 2003/001; A61H 2003/005; A61H 2003/0233; A61H 2003/0227; A61H 2003/0238; A45B 5/00
(Continued)

(56) References Cited

U.S. PATENT DOCUMENTS 1,184,575 A * 5/1916 Saylor ..... A61H 3/02 135/68
1,381,845 A * 6/1921 Kolchinsky ..... A47C 4/38 248/155.5
(Continued)

FOREIGN PATENT DOCUMENTS

CN 2396803 Y 9/2000
CN 2415747 Y 1/2001
(Continued)

OTHER PUBLICATIONS

PCT International Search report dated Apr. 19, 2018 in connection with PCT/CN2018/074944.
(Continued)

*Primary Examiner* — David R Dunn
*Assistant Examiner* — Danielle Jackson
(74) *Attorney, Agent, or Firm* — Amster, Rothstein & Ebenstein LLP

(57) ABSTRACT

A deformable crutch, includes a hand-held part, a seat part and a support part which are rotatably connected in sequence, and further includes a locking device for locking a rotation angle between the hand-held part and the seat part, and a rotation angle between the seat part and the support part. Rollers (34) are provided at the bottom of the deformed stool. A motor for driving the rollers (34) can also be mounted to deform the deformable crutch into an electric scooter.

12 Claims, 2 Drawing Sheets

(51) Int. Cl.
*A61H 3/04* (2006.01)
*A45B 9/02* (2006.01)
*A61H 3/00* (2006.01)

(52) U.S. Cl.
CPC ..... *A61H 2003/005* (2013.01); *A61H 2003/0233* (2013.01); *A61H 2003/043* (2013.01)

(58) Field of Classification Search
USPC ..... 135/66, 74
See application file for complete search history.

(56) References Cited

U.S. PATENT DOCUMENTS

| | | | | | |
|---|---|---|---|---|---|
| 2,127,976 | A * | 8/1938 | K-Howat | A45B 5/00 | 135/66 |
| 2,766,813 | A * | 10/1956 | Kay | A45B 5/00 | 297/54 |
| 3,272,210 | A * | 9/1966 | Boruvka | A61H 3/00 | 135/69 |
| 3,443,569 | A * | 5/1969 | Ernst | A61H 3/00 | 135/66 |
| 3,537,748 | A * | 11/1970 | Knapp | A61G 5/0833 | 297/118 |
| 4,910,927 | A * | 3/1990 | Beatty | A61H 3/02 | 135/66 |
| 5,090,434 | A * | 2/1992 | Hagen | A45B 5/00 | 135/66 |
| 7,614,414 | B2 * | 11/2009 | Jamshidi | A61H 3/02 | 135/66 |
| 8,146,615 | B1 * | 4/2012 | Rodriguez | A61H 3/02 | 135/68 |
| 9,808,392 | B2 * | 11/2017 | Haider | A61H 3/02 | |
| 10,092,475 | B2 * | 10/2018 | Smith | A61H 3/02 | |

FOREIGN PATENT DOCUMENTS

| | | | |
|---|---|---|---|
| CN | 202311584 | U | 7/2012 |
| CN | 104544814 | A | 4/2015 |
| CN | 205456627 | U | 8/2016 |
| CN | 106562530 | A | 4/2017 |
| CN | 206079349 | U | 4/2017 |
| CN | 106741055 | A | 5/2017 |
| JP | S58175211 | U | 11/1983 |
| JP | 2012035076 | A | 2/2012 |
| JP | 2017006604 | A | 1/2017 |
| KR | 20130001653 | U | 3/2013 |

OTHER PUBLICATIONS

First Office Action, dated Jun. 2, 2020, in connection with Australian Application No. 2018299361.
First Office Action dated Nov. 24, 2020 in connection with Japanese Patent Application No. 2020-518112.
Communication Extended European Search Report dated Mar. 12, 2021 in connection with European Patent Application No. 18832221.8.

* cited by examiner

DEFORMABLE CRUTCH

CROSS-REFERENCE TO RELATED APPLICATIONS

The present application claims the priority to the Chinese patent application NO. 201720840005.4, named "deformable walking stick", filed on Jul. 11, 2017, which is incorporated herein by reference in its entirety.

TECHNICAL FIELD

The present application relates to the technical field of the crutch, and particularly, relates to a deformable crutch.

BACKGROUND

As a necessary tool for the elderly population and the disabled population, the crutch has always had a fixed structure and shape. However, when the elderly people or the disabled people feel tired after walking, they often cannot rest on the spot. The crutch of the prior art is in a fixed structure form and has a single function, and is very inconvenient to carry.

SUMMARY

The present application is specifically realized through the following technical solutions:

A deformable crutch of the present application, includes a hand-held part, a seat part, and a support part arranged with rotatable connection in sequence, and further includes a lock device for locking a rotation angle between the hand-held part and the seat part, and a rotation angle between the seat part and the support part; when used as a crutch, the lock device can keep the hand-held part, the seat part and the support part in a vertical direction; both the hand-held part and the support part can be rotatably locked and supported on the ground, and the seat part can be used as a support surface for a stool surface to provide the user for a rest. A deformable crutch of the present application has a simple and reasonable structure and has the function of a stool.

The hand-held part includes a handlebar, a first connecting rod, a second connecting rod and a first cross rod. One end of the first connecting rod and one end of the second connecting rod are respectively connected with two ends of the handlebar, and the other end of the first connecting rod and the other end of the second connecting rod are respectively rotatably connected with two ends of the first cross rod.

As a further improvement, the hand-held part further includes a first reinforcing rod, and two ends of the first reinforcing rod are respectively connected with the first connecting rod and the second connecting rod. On the one hand, when used as a crutch for the elderly people or disabled people, the handlebar is clamped under the armpit, while the first reinforcing rod can be used as a handrail for convenient holding. On the other hand, when the crutch is deformed as a stool, the first reinforcing rod increases the structure strength of the hand-held part as a support leg, which improves the carrying capacity.

Specifically, the seat part includes a third connecting rod, a fourth connecting rod and a second cross rod. One end of the third connecting rod and one end of the fourth connecting rod are respectively rotatably connected with the first cross rod, and the other end of the third connecting rod and the other end of the fourth connecting rod are respectively rotatably connected with two ends of the second cross rod.

As a further improvement, the seat part further includes a second reinforcing rod, and two ends of the second reinforcing rod are respectively connected with the third connecting rod and the fourth connecting rod; or, two ends of the second reinforcing rod are respectively connected with the first cross rod and the second cross rod, and the second reinforcing rod can not only increase the structure stability of the seat part, but also share the load bearing of the third connecting rod and the fourth connecting rod, and prevent the third connecting rod and the fourth connecting rod from deforming and bending caused by a long time sitting pressure, to extend the service life of the deformable crutch.

Specifically, the support part includes a first support rod, and one end of the first support rod is rotatably connected with the second cross rod.

The lock device includes a first connecting pipe and a second connecting pipe arranged in vertical communication with each other. One end of the second connecting pipe is communicated with a middle portion of the first connecting pipe, and the communicating section of the first connecting pipe is provided with a first strip-shaped opening along the axial direction of the first connecting pipe, and the side wall of the second connecting pipe is provided with two parallel second strip-shaped openings which are vertically connected with the first strip-shaped opening. The outer peripheral side of the second connecting pipe is further provided with a seat pipe clamp or a hoop. In specific use, the first cross bar is inserted into the first connecting pipe of the two lock devices, and the third connecting rod and the fourth connecting rod are respectively inserted into the second connecting pipe of the two lock devices, which are tightly locked by the seat pipe clamp or the hoop; the second cross rod is inserted into the first connecting pipe of a lock device, and the first support rod is inserted into the second connecting pipe, which are tightly locked by the seat pipe clamp or the hoop.

As a further improvement, the deformable crutch further includes a second support rod and a third support rod. One end of the second support rod and one end of the third support rod are respectively hinged with one end of the first support rod far from the second cross rod, and the other end of the second support rod and the other end of the third support rod are respectively removably connected with the second cross rod; or, the first connecting rod is provided with a first blind hole, and the second connecting rod is provided with a second blind hole, and the other end of the second support rod can also be inserted into and matched with the first blind hole, and the other end of the third support rod can also be inserted into and matched with the second blind hole.

As a further improvement, one end of the second support rod and one end of the third support rod are rotatably connected with the first support rod through an elastic reset mechanism, respectively.

Furthermore, the elastic reset mechanism is a torsion spring, and the torsion spring is provided at a rotatable connection joint of the second support rod and the third support rod with the first support rod. When the torsion spring is in a normal state, one end of the torsion spring is clamped on the first support rod, and the other end of the torsion spring is clamped on the second support rod or the third support rod. At this time, the second support rod or the third support rod is parallel to the first support rod.

When used as a crutch, the second support rod and the third support rod can share the pressure on the first support rod at the upper end to prevent the excessive stress on the rotatable connection joint of the first support rod and the second cross rod. When used as a stool, the second support rod and the third support rod are respectively inserted into the first blind hole and the second blind hole, to enhance the structure stability when the stool is in use.

As a further improvement, a clamping slot is all respectively provided on a peripheral side wall of the insertion end of the second support rod and the third support rod. The width of the clamping slot is larger than the wall thickness of the first connecting rod and the second connecting rod. When used as a stool, the second support rod and the third support rod are respectively inserted into the first blind hole and the second blind hole, and then the second support rod or the third support rod are lightly pressed to clamp the pipe wall of the first connecting rod or the pipe wall of the second connecting rod into the clamping slot. The second support rod and the third support rod also play a role of fixing the stool.

As a further improvement, a plurality of rollers are further arranged at the lower portion of the second support rod and the third support rod. The crutch is deformed into a sliding stool, which is convenient for pushing or sliding.

As a further improvement, the first support rod is fixedly provided with a sleeve parallel to a first support rod. A control rod is inserted into the sleeve. The lower end of the control rod is provided with a driving wheel and an electric motor. The electric motor drives the driving wheel to transform the sliding stool into an electric scooter, which is more convenient for traveling and more convenient to carry.

BRIEF DESCRIPTION OF THE DRAWINGS

In order to explain the technical solutions in the embodiments of the present application or the prior art more clearly, the accompanying drawings used in the embodiments or the prior art will be briefly introduced below. Obviously, the described accompanying drawings below is only some embodiments of the present application. For those skilled in the art, other accompanying drawings can be obtained according to these accompanying drawings without making creative efforts.

DETAILED DESCRIPTION

In order to make the purpose, technical solutions, and advantages of the present application more clear, the technical solutions of the present application will be described in detail below. Obviously, the described embodiments are only a part of the embodiments of the present application, but not all the embodiments. Based on the embodiments in the present application, all other implementations obtained by those skilled in the art without making creative efforts belong to the protection scope of the present application.

Embodiment 1

Figure 1:
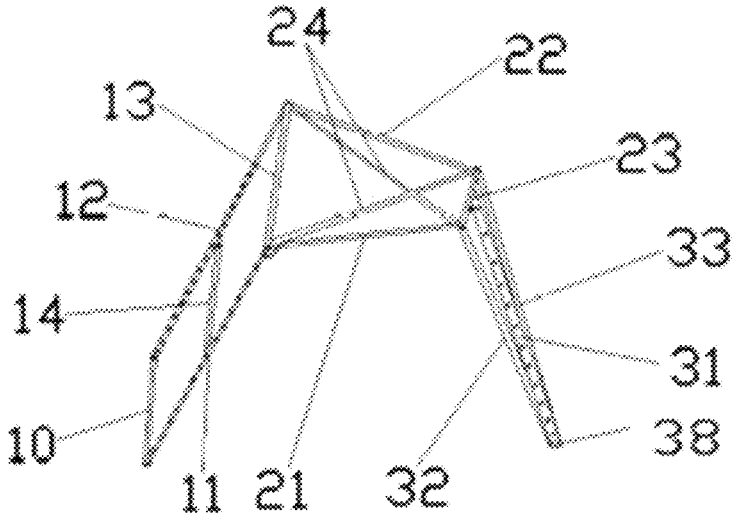
FIG. 1 is the structure view of a deformable crutch according to the embodiment of the present application.
Figure 2:
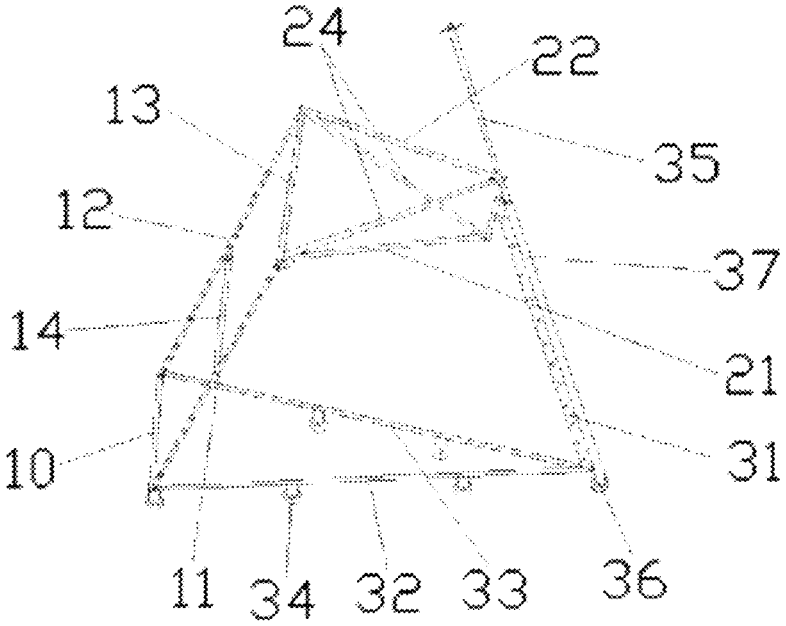
FIG. 2 is the structure view of a deformable crutch in another form according to the embodiment of the present application.
Figure 3:
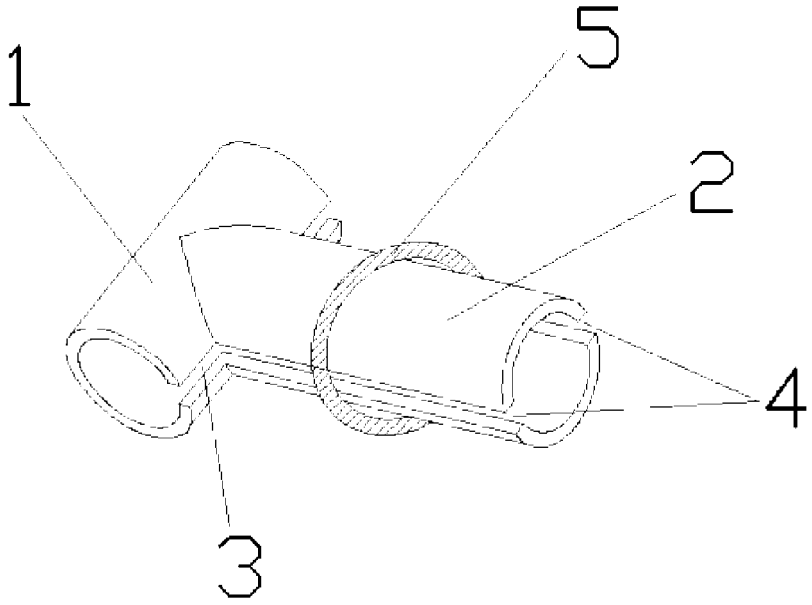
FIG. 3 is the structure view of the lock device of a deformable crutch according to the embodiment of the present application.

As shown in FIG. 1 and FIG. 3, the present embodiment provides a deformable crutch, which includes a hand-held part, a seat part, and a support part arranged with rotatable connection in sequence, and further includes a lock device for locking a rotation angle between the hand-held part and the seat part, and a rotation angle between the seat part and the support part.

The hand-held part includes a handlebar 10, a first connecting rod 11, a second connecting rod 12 and a first cross rod 13. One end of the first connecting rod 11 and one end of the second connecting rod 12 are respectively connected with two ends of the handlebar 10, and the other end of the first connecting rod 11 and the other end of the second connecting rod 12 are respectively connected with two ends of the first cross rod 13.

The hand-held part further includes a first reinforcing rod 14. Two ends of the reinforcing rod 14 are connected with the first connecting rod 11 and the second connecting rod 12, respectively. When used as a crutch for the elderly people or disabled people with mobility difficulties, the handlebar 10 is placed under the armpit, while the first reinforcing rod 14 can be used as a handrail for convenient holding. On the other hand, when the crutch is deformed as a stool, the first reinforcing rod 14 increases the structure strength of the hand-held part as a support leg, which improves the carrying capacity of the hand-held part.

The seat part includes a third connecting rod 21, a fourth connecting rod 22 and a second cross rod 23. One end of the third connecting rod 21 and one end of the fourth connecting rod 22 are respectively rotatably connected with the first cross rod 13, and the other end of the third connecting rod 21 and the other end of the fourth connecting rod 22 are respectively connected with two ends of the second cross rod 23.

The seat part further includes a second reinforcing rod 24. Two ends of the second reinforcing rod 24 are respectively connected with the third connecting rod 21 and the fourth connecting rod 22; or, two ends of the second reinforcing rod 24 are respectively connected with the first cross rod 13 and the second cross rod 23; or, one end of the second reinforcing rod 24 is connected with the third connecting rod 21 or the fourth connecting rod 22, and the other end of the second reinforcing rod 24 is connected with the first cross rod 13 or the second cross rod 23. The second reinforcing rod 24 can not only increase the structure stability of the seat part, but also share the load bearing of the third connecting rod 21 and the fourth connecting rod 22, and prevent the third connecting rod 21 and the fourth connecting rod 22 from deforming and bending caused by a long time sitting pressure, to extend the service life of the deformable crutch.

Specifically, the support part includes a first support rod 31, and one end of the first support rod 31 is rotatably connected with the second cross rod 23.

The lock device includes a first connecting pipe 1 and a second connecting pipe 2 arranged in vertical communication with each other. One end of the second connecting pipe 2 is communicated with a middle portion of the first connecting pipe 1. The connecting section of the first connecting pipe 1 is provided with a first strip-shaped opening 3 along the axial direction of the first connecting pipe 1. The side wall of the second connecting pipe 2 is provided with two parallel second strip-shaped openings 4 which are vertically connected with the first strip-shaped opening 3. The outer peripheral side of the second connecting pipe 2 is further provided with a seat pipe clamp 5. In specific use, the first cross rod 13 is inserted into the first connecting pipe 1 of the two lock devices, and the third connecting rod 21 and the fourth connecting rod 22 are respectively inserted into the second connecting pipe 2 of the two lock devices, which are tightly locked by the seat pipe clamp 5; the second cross rod 23 is inserted into the first connecting pipe 1 of a lock device, and the first support rod 31 is inserted into the second connecting pipe 2, which is tightly locked by the seat pipe clamp 5.

Embodiment 2

The present embodiment is a further improvement on the basis of the above-mentioned embodiment 1. In order to better realize the present application, the following structure is particularly adopted:

The deformable crutch further includes a second support rod 32 and a third support rod 33. One end of the second support rod 32 and one end of the third support rod 33 are respectively rotatably connected with one end of the first support rod 31 far from the second cross rod 23, and the other end of the second support rod 32 and the other end of the third support rod 33 are respectively removably connected with the second cross rod 23. The first connecting rod 11 is provided with a first blind hole, and the second connecting rod 12 is provided with a second blind hole. The other end of the second support rod 32 can also be inserted into and matched with the first blind hole, and the other end of the third support rod 33 can also be inserted into and matched with the second blind hole.

As a further improvement, a clamping slot is all respectively provided on a peripheral side wall of the insertion end of the second support rod 32 and the third support rod 33. The width of the clamping slot is larger than the wall thickness of the first connecting rod 11 and the second connecting rod 12. When used as a stool, the second support rod 32 and the third support rod 33 are respectively inserted into the first blind hole and the second blind hole, and then the second support rod 32 or the third support rod 33 are lightly pressed to clamp the pipe wall of the first connecting rod 11 or the pipe wall of the second connecting rod 12 into the clamping slot; at this time, the second support rod 32 and the third support rod 33 also have a lock effect on the rotation of the hand-held part, the seat part and the support part, and the structure stability is enhanced.

Embodiment 3

The present embodiment is a further improvement on the basis of the above-mentioned embodiment 2. In order to better realize the present application, the following structure is particularly adopted:

The second support rod 32 and the third support rod 33 are rotatably connected with the first support rod 31 through an elastic reset mechanism, respectively.

Furthermore, the elastic reset mechanism is a torsion spring 38, and the torsion spring 38 is provided at a rotatable connection joint of the second support rod 32 and the third support rod 33 with the first support rod 31. When the torsion spring 38 is in a normal state, one end of the torsion spring 38 is clamped on the first support rod 31, and the other end of the torsion spring 38 is clamped on the second support rod 32 or the third support rod 33. At this time, the second support rod 32 or the third support rod 33 is parallel to the first support rod 31.

Both the second support rod 32 and the third support rod 33 are rotatably connected with the first support rod 31 through the elastic reset mechanism. When used as a crutch, the second support rod and the third support rod can be automatically reset to a position parallel to the first support rod 31, which will not affect the normal walking.

Embodiment 4

The present embodiment is a further improvement on the basis of the above-mentioned embodiment 3. In order to better realize the present application, the following structure is particularly adopted:

When used as a stool, the second support rod 32 and the third support rod 33 are inserted into and matched with the first blind hole and the second blind hole, respectively;

As a further improvement, a plurality of rollers 34 are further arranged at the lower portion of the second support rod 32 and the third support rod 33. At this time, the crutch is deformed into a sliding stool, which is convenient for carrying.

Embodiment 5

The present embodiment is a further improvement on the basis of the above-mentioned embodiment 4. In order to better realize the present application, the following structure is particularly adopted:

A sleeve 37 is also fixed on the side wall of the first support rod 31. The axial direction of the sleeve 37 is parallel to the length direction of the first support rod 31. A control rod 35 is inserted into the sleeve 37. The lower end of the control rod 35 is provided with a driving wheel 36 and an electric motor. The lower end of the control rod 35 is provided with a double fork for holding the driving wheel 36. Both sides of the driving wheel 36 are rotatably connected with the double fork through a fixedly arranged rotation shaft. The rotation shaft is provided with a transmission gear, and the electric motor output shaft is provided with a driving gear engaged with the transmission gear. The electric motor is fixedly arranged on the control rod 35, and the electric motor drives the driving wheel 36.

As a further improvement, the upper end of the control rod is provided with a handlebar, and the control rod further includes a brake system. The brake system includes a V-brake composed of a brake handle, a brake cable and two brake pads which are connected in sequence. The brake handle is arranged on the upper end of the control rod and is connected with the handlebar, and the two brake pads clamp the driving wheel.

As a further improvement, all the connecting rods are hollow tubular structures with a certain wall thickness, which reduces the weight of the crutch and is portable.

The above-mentioned is only the detailed description of the present application, but the protection scope of the present application is not limited to herein. The changes or replacements that any of those skilled in the art can easily think of within the technical scope disclosed in the present application, should be all covered within the protection scope of the present application. Therefore, the protection scope of the present application should be subject to the protection scope of the claims.

What is claimed is:

1. A deformable crutch, comprising:

a hand-held part;

a seat part;

a support part; and a plurality of lock devices for locking a rotation angle between the hand-held part and the seat part, and a rotation angle between the seat part and the support part;

wherein the hand-held part comprises a handlebar (10), a first connecting rod (11), a second connecting rod (12), and a first cross rod (13), and one end of the first connecting rod (11) and one end of the second connecting rod (12) are respectively connected with two ends of the handlebar (10), and another end of the first connecting rod (11) and another end of the second connecting rod (12) are respectively connected with two ends of the first cross rod (13), wherein the seat part comprises a third connecting rod (21), a fourth connecting rod (22) and a second cross rod (23), and one end of the third connecting rod (21) and one end of the fourth connecting rod (22) are respectively rotatably connected with the first cross rod (13), and another end of the third connecting rod (21) and another end of the fourth connecting rod (22) are respectively connected with two ends of the second cross rod (23), and wherein the seat part further comprises a second reinforcing rod (24), and two ends of the second reinforcing rod (24) are respectively connected with the third connecting rod (21) and the fourth connecting rod (22); or, two ends of the second reinforcing rod (24) are respectively connected with the first cross rod (13) and the second cross rod (23).

2. The deformable crutch according to claim 1, wherein the hand-held part further comprises a first reinforcing rod (14), and two ends of the first reinforcing rod (14) are connected with the first connecting rod (11) and the second connecting rod (12), respectively.

3. The deformable crutch according to claim 1, wherein the support part comprises a first support rod (31), and one end of the first support rod (31) is rotatably connected with the second cross rod (23).

4. The deformable crutch according to claim 3, wherein a first lock device of the plurality of lock devices is arranged at a rotation connection joint of the hand-held part and the seat part, and a second lock device of the plurality of lock device is arranged at a rotation connection joint of the seat part and the support part.

5. The deformable crutch according to claim 4, wherein each of the plurality of lock devices comprises a first connecting pipe (1) and a second connecting pipe (2), and one end of the second connecting pipe (2) is communicated with a middle portion of the first connecting pipe (1), and a connecting section of the first connecting pipe (1) is provided with a first strip-shaped opening (3) along the axial direction of the first connecting pipe (1), and the side wall of the second connecting pipe (2) is provided with two parallel second strip-shaped openings (4) which are arranged perpendicular with respect to the first strip-shaped opening (3), and an outer peripheral side of the second connecting pipe (2) is further provided with a seat pipe clamp (5).

6. The deformable crutch according to any of claim 5, wherein the support part further comprises a second support rod (32) and a third support rod (33), and one end of the second support rod (32) and one end of the third support rod (33) are respectively hinged with one end of the first support rod (31) far from the second cross rod (23), and another end of the second support rod (32) and another end of the third support rod (33) are respectively removably connected with the second cross rod (23); or, the first connecting rod (11) is provided with a first blind hole, the second connecting rod (12) is provided with a second blind hole, and another end of the second support rod (32) and another end of the third support rod (33) are respectively inserted into and matched with the first blind hole and the second blind hole.

7. The deformable crutch according to any of claim 4, wherein the support part further comprises a second support rod (32) and a third support rod (33), and one end of the second support rod (32) and one end of the third support rod (33) are respectively hinged with one end of the first support rod (31) far from the second cross rod (23), and another end of the second support rod (32) and another end of the third support rod (33) are respectively removably connected with the second cross rod (23); or, the first connecting rod (11) is provided with a first blind hole, the second connecting rod (12) is provided with a second blind hole, and another end of the second support rod (32) and another end of the third support rod (33) are respectively inserted into and matched with the first blind hole and the second blind hole.

8. The deformable crutch according to claim 3, wherein the support part further comprises a second support rod (32) and a third support rod (33), and one end of the second support rod (32) and one end of the third support rod (33) are respectively hinged with one end of the first support rod (31) far from the second cross rod (23), and another end of the second support rod (32) and another end of the third support rod (33) are respectively removably connected with the second cross rod (23); or, the first connecting rod (11) is provided with a first blind hole, the second connecting rod (12) is provided with a second blind hole, and another end of the second support rod (32) and another end of the third support rod (33) are respectively inserted into and matched with the first blind hole and the second blind hole.

9. The deformable crutch according to claim 8, wherein the second support rod (32) and the third support rod (33) are rotatably connected with the first support rod (31) through respective elastic reset mechanisms.

10. The deformable crutch according to claim 9, wherein the elastic reset mechanisms are torsion springs, and each torsion spring is provided at a respective rotatable connection joint of the second support rod (32) and the third support rod (33) with the first support rod (31).

11. The deformable crutch according to claim 8, wherein a plurality of rollers (34) are further arranged at a lower portion of the second support rod (32) and the third support rod (33).

12. The deformable crutch according to claim 11, wherein a sleeve (37) is further fixed on a side wall of the first support rod (31), and the axial direction of the sleeve (37) is parallel to the length direction of the first support rod (31), and a control rod (35) is inserted into the sleeve (37), and a lower end of the control rod (35) is provided with a driving wheel (36) and an electric motor, and the electric motor drives the driving wheel (36).

* * * * *